US007703893B2

(12) United States Patent
Gröninger et al.

(10) Patent No.: US 7,703,893 B2
(45) Date of Patent: Apr. 27, 2010

(54) INKJET SYSTEM, METHOD OF MAKING THIS SYSTEM, AND USE OF SAID SYSTEM

(75) Inventors: Mark A. Gröninger, Venlo (NL); Marcus J. Van Den Berg, Venlo (NL); Hermanus M. A. Wijshoff, Grevenbicht (NL)

(73) Assignee: Océ-Technologies B.V., Venlo (NL)

( * ) Notice: Subject to any disclaimer, the term of this patent is extended or adjusted under 35 U.S.C. 154(b) by 306 days.

(21) Appl. No.: 11/158,081

(22) Filed: Jun. 22, 2005

(65) Prior Publication Data

US 2005/0285908 A1 Dec. 29, 2005

(30) Foreign Application Priority Data

Jun. 23, 2004 (NL) ..... 1026486

(51) Int. Cl.
*B41J 2/05* (2006.01)
*B41J 29/393* (2006.01)

(52) U.S. Cl. ..... 347/65; 347/19

(58) Field of Classification Search ..... 347/9, 347/65

See application file for complete search history.

(56) References Cited

U.S. PATENT DOCUMENTS

| | | | | |
|---|---|---|---|---|
| 4,498,088 | A | 2/1985 | Kanayama | |
| 4,518,974 | A | 5/1985 | Isayama | |
| 5,500,657 | A | 3/1996 | Yauchi et al. | |
| 6,375,299 | B1 * | 4/2002 | Foster et al. | 347/19 |

FOREIGN PATENT DOCUMENTS

| | | | |
|---|---|---|---|
| DE | 19958889 | A1 | 6/2000 |
| EP | 1013453 | A2 | 6/2000 |

* cited by examiner

*Primary Examiner*—Matthew Luu
*Assistant Examiner*—Lisa M Solomon
(74) *Attorney, Agent, or Firm*—Birch, Stewart, Kolasch & Birch LLP

(57) ABSTRACT

An inkjet system including a printhead with an ink-fillable chamber operatively connected to a piezoelectric actuator and provided with a nozzle for the ejection of ink drops in response to the energization of the actuator, which actuator is connected to a measuring circuit for measuring an electrical signal generated by the actuator in response to the deformation thereof, wherein the system is configured such that a natural frequency of said system corresponds substantially to a natural frequency of a disturbance in the system.

10 Claims, 6 Drawing Sheets

INKJET SYSTEM, METHOD OF MAKING THIS SYSTEM, AND USE OF SAID SYSTEM

This Nonprovisional application claims priority under 35 U.S.C. §119(a) on Patent Application No(s). 1026486 filed in The Netherlands on Jun. 23, 2004, the entire contents of which are hereby incorporated by reference.

BACKGROUND OF THE INVENTION

The present invention relates to an inkjet system including a printhead comprising an ink-fillable chamber operatively connected to a piezoelectric actuator and provided with a nozzle for the ejection of ink drops in response to the energization of the actuator, said actuator being connected to a measuring circuit for measuring an electric signal generated by the actuator in response to the deformation thereof. The present invention also relates to a method of making such a system and use of said system in forming an image on a receiving material.

A system of this kind is known from European Application EP 1 013 453. This system forms part of an inkjet printer with which receiving materials can be printed. The known system is of the piezo type and has a printhead with an ink chamber (also termed an "ink duct" or, briefly, a "duct") operatively connected to a piezoelectric actuator. In one embodiment the ink chamber has a flexible wall which is deformable by energization of the actuator connected to said wall. Deformation of the wall results in an acoustic pressure wave in the chamber which, given adequate strength, will result in ejection of an ink drop from the nozzle of that chamber. The pressure wave in turn, however, results in a deformation of the wall, and this can be fed to the piezoelectric actuator. This will generate an electrical signal under the influence of its deformation.

From this application it is recognized that an analysis of this signal can provide information as to the state of the ink chamber corresponding to the particular actuator. Thus it is possible to derive from the signal whether there is an air bubble or some other disturbance in the chamber, whether the nozzle is clean, whether there are mechanical defects in the ink chamber, and so on. In principle, any disturbance of influence on the pressure wave can be traced by analysing the signal.

A disadvantage of the known method is that the signal generated by the piezoelectric actuator in response to its deformation by the pressure wave in the duct is often very complex, apart from the possible presence of random disturbances (noise). It has been found that the pressure wave in the duct is not a simple sine curve or some other simple wave configuration. This would, in fact, result in a comparably simple electrical signal. Apparently the pressure wave is not solely determined by the deformation of the actuator directly preceding the drop ejection, but there are also a number of other events which influence the pressure wave. Another consequence of this complex pressure wave is that the signal generated by the actuator as a result of this pressure wave is also very complex. Analysis of such a complex signal requires a complex, preferably digital, measuring circuit and/or relatively long processing times. This is particularly disadvantageous, especially for printers with many ink chambers in which each ink chamber of the printer is checked for disturbances after each energization. Making each chamber measurable by such a complex circuit after each energization is economically unattractive, and in addition it will often be difficult to round off an analysis within the time available until the next ink drop should be ejected from this chamber (typically $10^{-4}$ seconds). It should be clear that, particularly for applications in which high print quality is required, for example the printing of color photographs and making publicity posters, it is desirable to check each ink chamber after each energization.

SUMMARY OF THE INVENTION

The object of the present invention is to provide a method and system whereby the above-described disadvantages are obviated. To this end, a method has been invented wherein the system is so configured that a natural frequency of the system substantially corresponds to a natural frequency of a disturbance in the system. The advantage of this system is that the disturbance is expressed relatively strongly in the electrical signal generated by the piezoelectric actuator as a result of its deformation by the pressure wave. Resonance of the disturbance takes place namely at a frequency which is just provided by the system. This means that the analysis of the signal can remain restricted to a small area around the natural frequency of the system and also it is possible to use simple electronics, precisely because the contribution in the electric signal as a result of the disturbance is amplified by the system. For the application of the present invention it is incidentally not essential that the natural frequency of the system should be exactly equal to the natural frequency of the disturbance. Since there is a region around the natural frequency of the system, or a "window", where there is already amplification in the signal, it is sufficient for the window to enclose the natural frequency of the disturbance. In this way the natural frequencies sufficiently correspond to one another.

The present invention is based on a number of considerations. For example, the applicants have recognised that an inkjet system of the piezo type has one or more natural frequencies. If, for example, an acoustic pressure wave is generated in the ink chamber in which each frequency is represented equally strongly (known as "white noise"), then the electrical signal received by the measuring circuit will have a number of frequencies at which said signal is relatively strong (first, second and other harmonic frequencies). These frequencies are termed natural frequencies. Investigation has shown that the position of these natural frequencies should be controlled because this appears to be dependent on the configuration of the system. For example, the position can be influenced by adapting the geometry of the ink chamber, the geometry of the nozzle, the type of ink, the type of actuator, and so on. The applicant has also recognised that a specific type of disturbance, for example an air bubble, also has an natural frequency at which it resonates. By so configuring the system such that a natural frequency of the system is close to a natural frequency of the disturbance, it can be noticed very easily in the signal. A configuration with which a natural frequency of the system coincides with a natural frequency of a disturbance can be found by experimentation, for example by adapting the geometry of the duct, and/or the geometry of an inflow opening of the duct, and/or the geometry of the nozzle, and/or the geometry and/or the construction of the piezo actuator, and/or the type of ink (in brief anything that influences the natural frequencies of the system), and determining the natural frequency or frequencies in each case. It can also be determined by calculation by the use of a suitable acoustic model of the system. The natural frequency of a disturbance can also be determined experimentally or by calculation.

The advantage of the present invention is that analysis of the signal generated by the actuator can be effected with very simple electronics, and yet an adequate tracing of disturbances can be found. A disturbance in the context of the present invention is an irregularity in the system regarded as unacceptable. This can, for example, be the case if the irregularity can result in a print artefact visible to the human eye in the printed image, or if the irregularity can result in damage to the printer. The unacceptability of an irregularity may vary from one application to another.

In one embodiment, a natural frequency of the system substantially corresponds to a natural frequency of an air bubble of a size such that it noticeably influences the ejection of ink drops. It is generally known that one or more air bubbles may be located in an ink duct. On the one hand, they can be present in the ink itself and possibly even grow in the ink duct, on the other hand they can also form in the ink duct, particularly because of negative pressures which can be generated in the ink duct (cavitation). However, many of these air bubbles are not a disturbance in the sense of the present invention. They are often so small that they have no noticeable influence on the jetting process and disappear automatically after a specific time or after a number of energizations of the actuator. However, a critical value can be determined for an air bubble at which it just will noticeably influence the ejection of the ink drops. In this embodiment, the natural frequency of an air bubble having this critical value just falls in the window around the natural frequency of the system. In this way, air bubbles which have a size below the critical value can simply be disregarded. As soon as a bubble becomes so great that it can be regarded as a disturbance, it can simply be rendered visible in the signal generated by the actuator.

In another embodiment, the measuring circuit comprises a mixer in order to mix with the signal a frequency equal to the natural frequency of the system. The advantage of this embodiment is that the presence of an air bubble with a critical value can be noted very simply, for example using a low-pass filter. By mixing (multiplying) with the natural frequency of the system (which frequency substantially corresponds to that of the disturbance), the disturbance will be visible at a frequency substantially equal to zero. This offers the possibility of detecting the disturbance by the use of very simple electronics.

The present invention also covers a method of making an inkjet system comprising forming an ink chamber with a nozzle for the ejection of ink drops from the chamber, which ink chamber is operatively connected to a piezoelectric actuator, connecting the actuator to a measuring circuit, wherein the system is so configured that a natural frequency of the system is substantially equal to a natural frequency of a disturbance in the system. In addition, the invention also relates to application of the above-described system to the formation of an image on a receiving material.

BRIEF DESCRIPTION OF THE DRAWINGS

The present invention will now be explained in detail with reference to the following drawings, wherein.

DETAILED DESCRIPTION OF THE INVENTION

Figure 1:
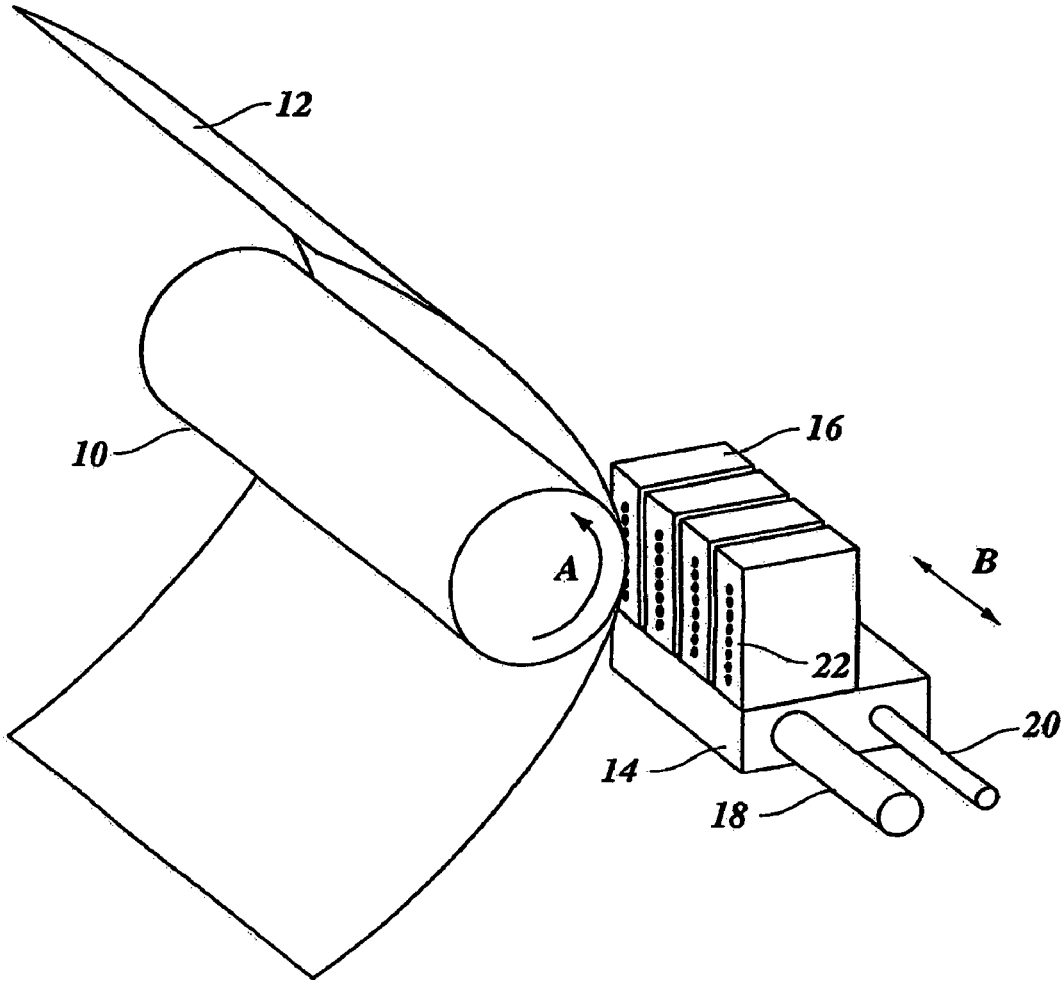
FIG. 1 is a diagram of an inkjet printer.

FIG. 1 diagrammatically illustrates an inkjet printer. In this embodiment, the printer comprises a roller 10 to support a receiving medium 12 and guided along the four printheads 16. The roller 10 is rotatable about its axis as indicated by arrow A. A carriage 14 carries the four printheads 16, one for each of the colors cyan, magenta, yellow and black, and can be moved in reciprocation in a direction indicated by the double arrow B, parallel to the roller 10. In this way the printheads 16 can scan the receiving medium 12. The carriage 14 is guided over rods 18 and 20 and is driven by suitable means (not shown).

In the embodiment as shown in the drawing, each printhead 16 comprises eight ink chambers, each with its own nozzle 22, which form an imaginary line perpendicular to the axis of the roller 10. In a practical embodiment of a printing device, the number of ink chambers per printhead 16 is many times greater. Each ink chamber is provided with a piezoelectric actuator (not shown) and associated actuation and measuring circuit (not shown) as described in connection with FIGS. 2 and 3. Each of the printheads also comprises a control unit for adapting the actuation pulses. In this way, the ink chamber, the actuator, the actuation circuit, the measuring circuit and the control unit form a system serving to eject ink drops in the direction of the roller 10. It is incidentally not essential for the control unit and/or for example all the elements of the actuation and measuring circuit to be physically integrated in the actual printheads 16. It is also possible for these parts to be disposed, for example, in the carriage 14 or even in a more remote part of the printer, there being connections to components in the printheads themselves. In this way, however, these parts form a functional component of the printheads without actually being physically built into the printheads. If the actuators are actuated image-wise, an image forms which is built up from individual ink drops on the receiving medium 12.

Figure 2:
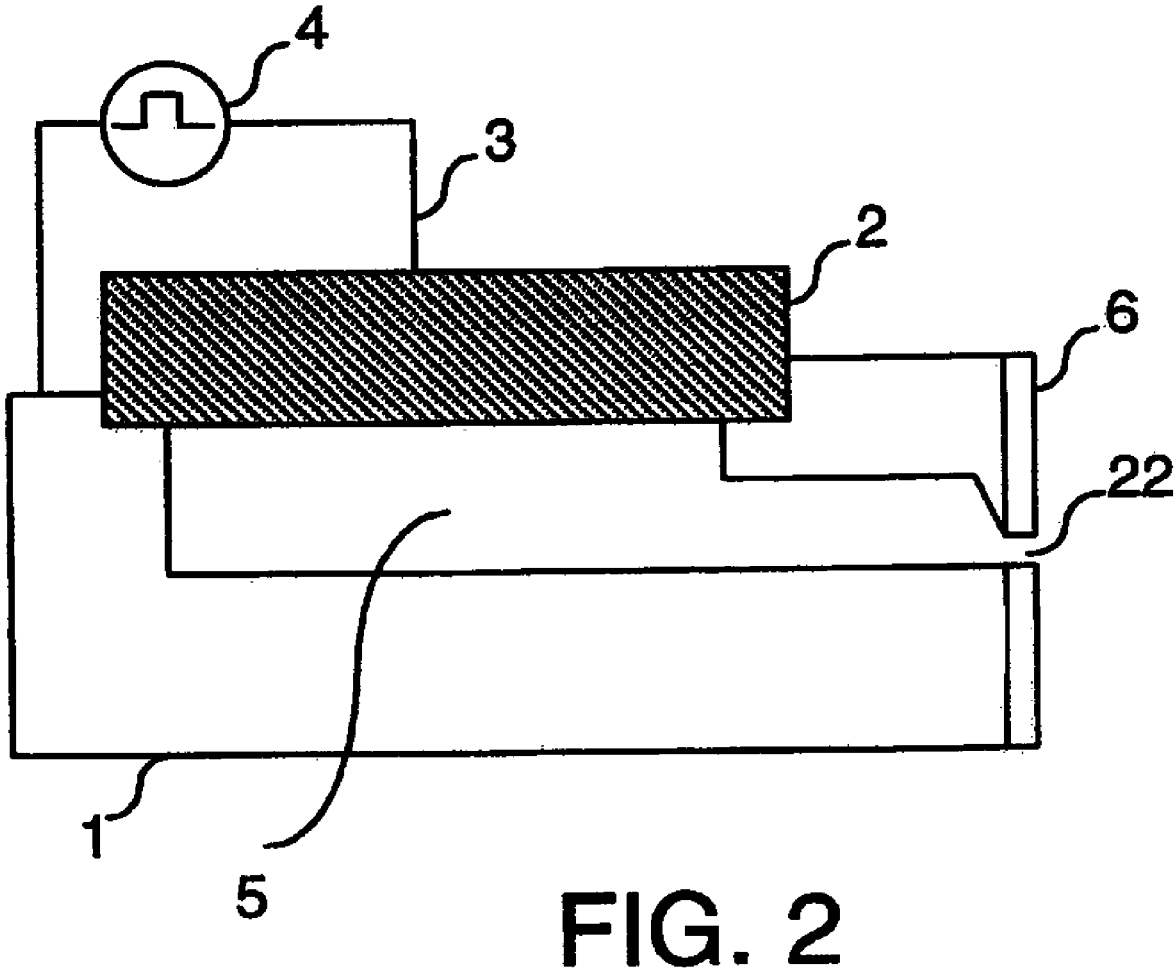
FIG. 2 is a diagram of a system forming part of said printer.

In FIG. 2 an ink chamber 5 is provided with an electromechanical actuator 2, in this example a piezoelectric actuator. Ink chamber 5 is formed by a groove in baseplate 1 and is bounded at the top mainly by the piezoelectric actuator 2. At the end, the ink chamber 5 merges into a nozzle 22, the opening being formed by a nozzle plate 6 in which there is a recess at the location of the duct. When a pulse is applied across actuator 2 by a pulse generator 4 via the actuation circuit 3, the actuator deflects in the direction of the duct. In this way the pressure in the duct is suddenly raised, so that an ink drop is ejected from the nozzle 22. Upon completion of the drop ejection there is still a pressure wave present in the duct, and this decays in the course of time. This wave in turn results in a deformation of the actuator 2, which generates an electric signal in response. This signal is dependent on all the parameters which influence the formation of the pressure wave and the damping of said wave. In this way, information concerning these parameters can be obtained by measuring said signal. This information can in turn be used to control the print process.

Figure 3A:
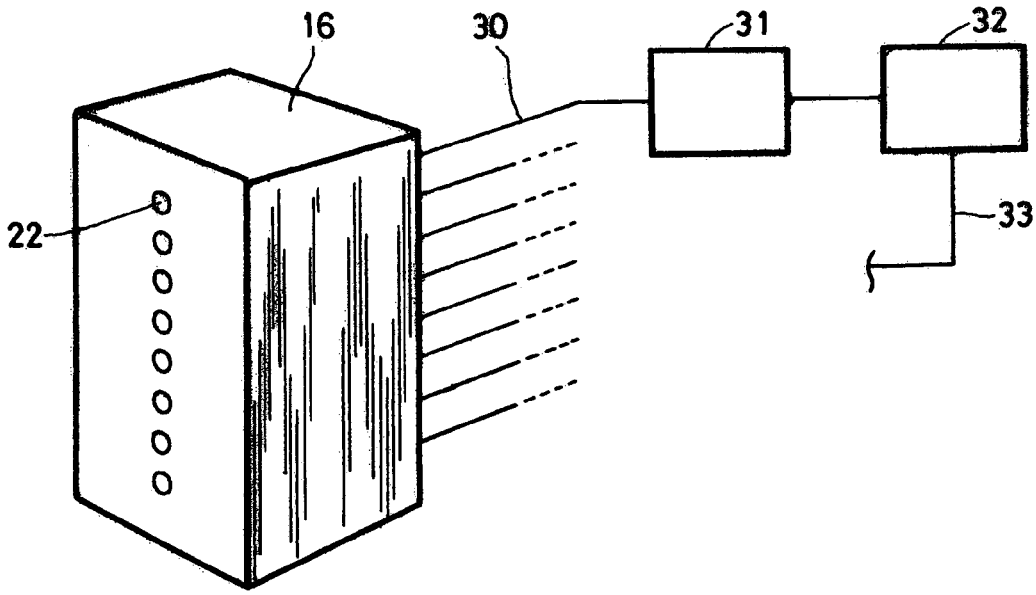
FIG. 3 is a diagram showing the conversion of an acoustic signal to an electric signal.
Figure 3B:
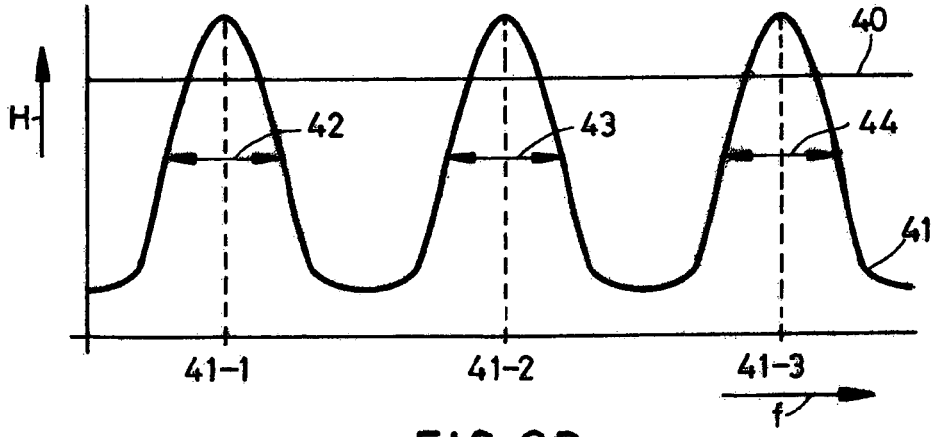

FIGS. 3A and 3B diagrammatically show the conversion of an acoustic signal to an electrical signal. FIG. 3A shows an inkjet printhead 16. The printhead is provided with nozzles 22 at the front. Each of the ink chambers corresponding to the nozzles 22 is connected to a measuring circuit 31 via line 30. For clarification purposes, FIG. 3A shows only one ink chamber in actual fact as connected to a measuring circuit. The measuring circuit can be constructed in various ways as is sufficiently known from the prior art, for example from European Patent Applications EP 1 378 359, EP 1 378 360 and EP 1 378 361. The measuring circuit 31 is in turn connected to control unit 32 which processes the data coming from the measuring circuit and uses them in controlling the ink chambers of the printhead 16. For this purpose the control unit is provided with a line 33.

FIG. 3B diagrammatically shows how the inkjet system as described in FIG. 2 converts an acoustic vibration (pressure wave) in the ink duct into an electric signal. The vertical axis in this drawing shows the signal strength in arbitrary units H while the horizontal axis plots the frequency f. In the hypothetical case where acoustic white noise 40 (all the frequencies being represented equally strongly) is to be applied to the duct, the piezoelectric actuator would in response to deformation as a result of the corresponding pressure wave deliver an electric signal 41 to the measuring circuit. It will be seen that this signal has a number of natural frequencies 41-1, 41-2, 41-3, etc. This means that a pressure wave having a frequency corresponding to a natural frequency is reflected relatively strongly in said electric signal.

It will be seen that the position of the natural frequencies is determined by the configuration of the system. With a different nozzle size or shape, for example, the natural frequencies shift to different positions. The duct length, cross-section, shape and size of the filling opening, and also the type of ink, type of actuator, mechanical construction of the printhead, etc., also influence the position of the natural frequencies. This offers the possibility of placing the one or more natural frequencies at preselected positions.

FIG. 3B also shows windows 42, 43 and 44 around the natural frequencies. These windows can be arbitrarily selected. In this example, the boundaries of the window correspond to the frequency range considered.

Figure 4:
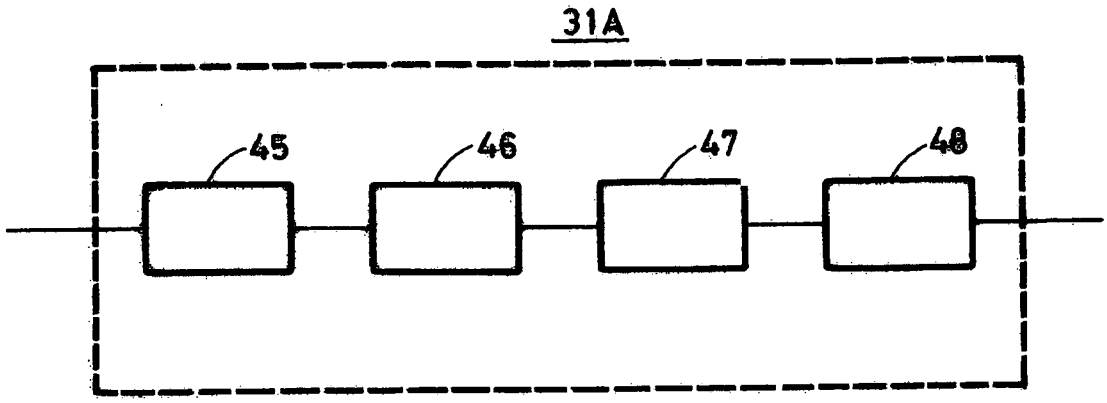
FIG. 4 is a diagram showing part of a measuring circuit of the kind that can be used in an inkjet system as known from the prior art.

FIG. 4 is a diagram showing part of a measuring circuit 31 of the kind that can be used in an inkjet system as known from the prior art. In this system the entire signal such as the one the piezoelectric actuator generates is analyzed. As known from the prior art, for example from EP 1 075 952, a signal of this kind can be complex. Complex digital electronics are therefore often used for its analysis. One way in which this can be implemented is shown in the drawing, which illustrates a specific embodiment 31*a* of a (part of the) measuring circuit.

Component 45 is a front-end unit which converts to a voltage signal, the incoming current signal as generated by the actuator. This signal is then fed to an A/D converter 46 to make the signal suitable for processing by digital unit 47. This digital signal processor processes the signal so that it can be analyzed in analysing unit 48 by the use of an adequate algorithm, particularly in order to prevent disturbances such as air bubbles. After an analysis, the control unit (not shown) is informed whether the duct is or is not free of disturbances. If not, then if this is relevant, information concerning the type of disturbance is transmitted so that adequate action can be taken to remove it. In particular the components 47 and 48 make this measuring circuit expensive and thus this application is therefore not attractive economically.

Figure 5A:
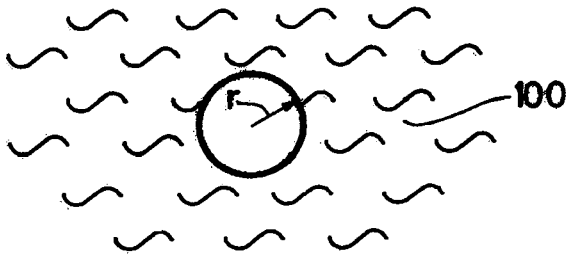
FIG. 5 is a diagram of an air bubble in an infinitely large quantity of liquid.
Figure 5B:
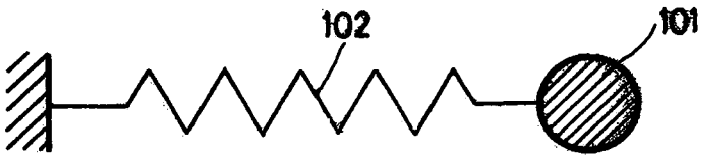

FIG. 5A diagrammatically illustrates an air bubble in an infinitely large quantity of liquid. This air bubble 100 has a radius r. At a specific acoustic frequency the bubble will resonate. This depends on the density of the liquid, the radius of the bubble and so on. These resonant frequencies can be considered as adequately known from hydrodynamics, for example with the use of formula 1

$$f=1/(2\pi*\sqrt{(3\gamma*p_o/(r_o*R_o^2))}) \quad (1)$$

wherein f is the (fundamental) resonant frequency, $\gamma$ is the adiabatic exponent, $p_o$ is the ambient pressure, $r_o$ is the density of the liquid and $R_o$ is the equilibrium radius of the bubble. A simple model that can be used to determine a resonant frequency of an air bubble is shown in FIG. 5B. This model represents the air bubble as a mass-spring system. Both the mass 101 and the spring constant of the spring 102 are a function of the radius of the bubble.

It will be clear to one skilled in the art that the resonant frequency of an air bubble located in a finite quantity of ink in an ink duct is not exactly equal to the resonant frequency of the same air bubble located in an infinitely large quantity of liquid. However, if the dimensions of the bubble are sufficiently small with respect to the dimensions of the duct, the difference will not be sufficiently relevant to the practical application of the invention. Since the air bubbles in an ink duct frequently grow from very small bubbles to larger bubbles, they can be detected at a time they are still small enough with respect to the dimensions of the duct.

Figure 6:
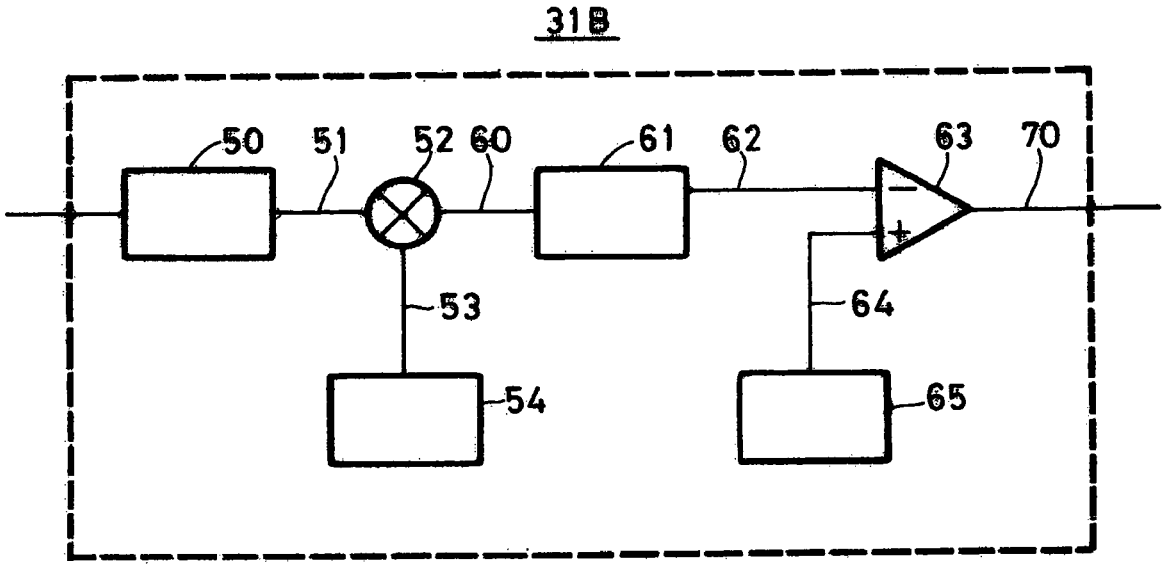
FIG. 6 is a diagram showing part of the measuring circuit of the kind that can be used in the present invention.

FIG. 6 is a diagram showing part of the measuring circuit of the kind that can be used in the present invention. For this purpose, the measuring circuit 31B comprises a driver and front-end unit 50 to receive the incoming signal and convert it into a voltage signal $f_s$. This signal $f_s$ is fed via line 51 to a multiplier 52. This mixes (technically this is actually multiplying) the signal with a natural frequency $f_x$ (at least a frequency equal to this natural frequency) of the system. This natural frequency $f_x$ is generated by oscillator 54 and fed to the multiplier 52 via line 53. The mixed signal is fed via line 60 to a low-pass filter 61. The filtered signal is fed via line 62 to comparator 63 and compared with a reference signal generated by unit 65 and fed via line 64 to the same amplifier. If the filtered signal is completely below the reference signal, then "nozzle OK" is fed as the status via line 70 to the control unit. If the filtered signal is above the reference signal, then the status "nozzle not OK" is fed to the control unit, with or without supplementary information concerning the type and nature of the disturbance. In principle, each of the ink ducts of the inkjet printhead according to this example is connected to a measuring circuit of this kind.

Figure 7B:
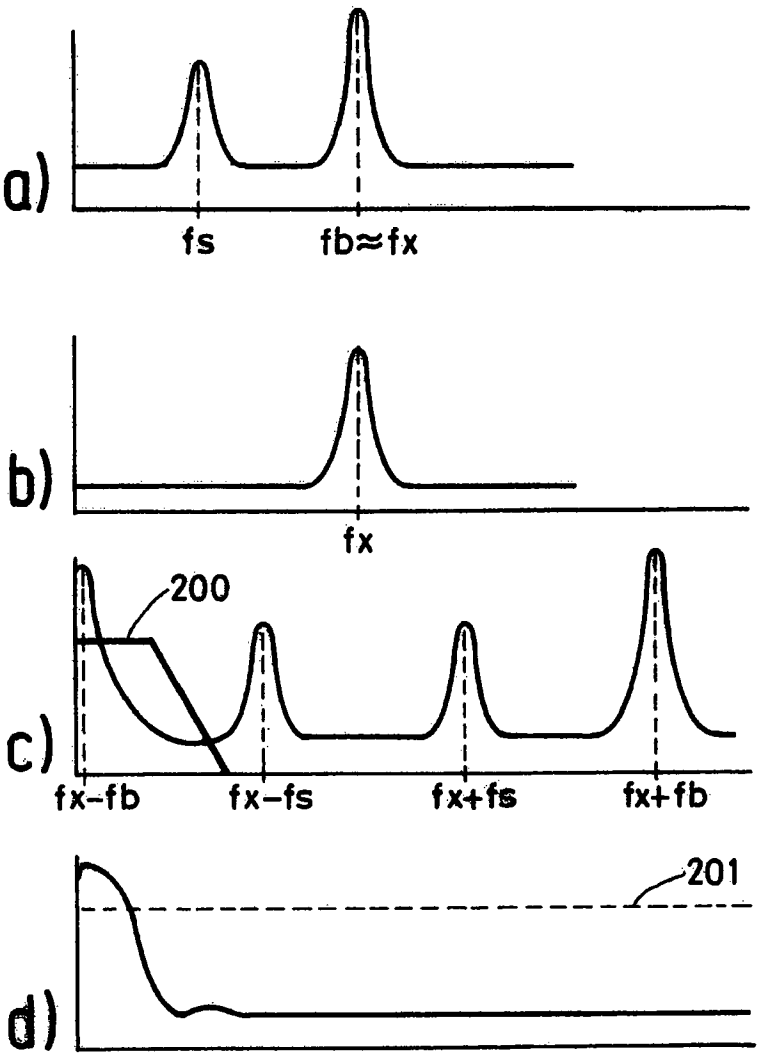
FIG. 7 is a diagram showing signals of the kind that can occur in the system according to the present invention.
Figure 7A:
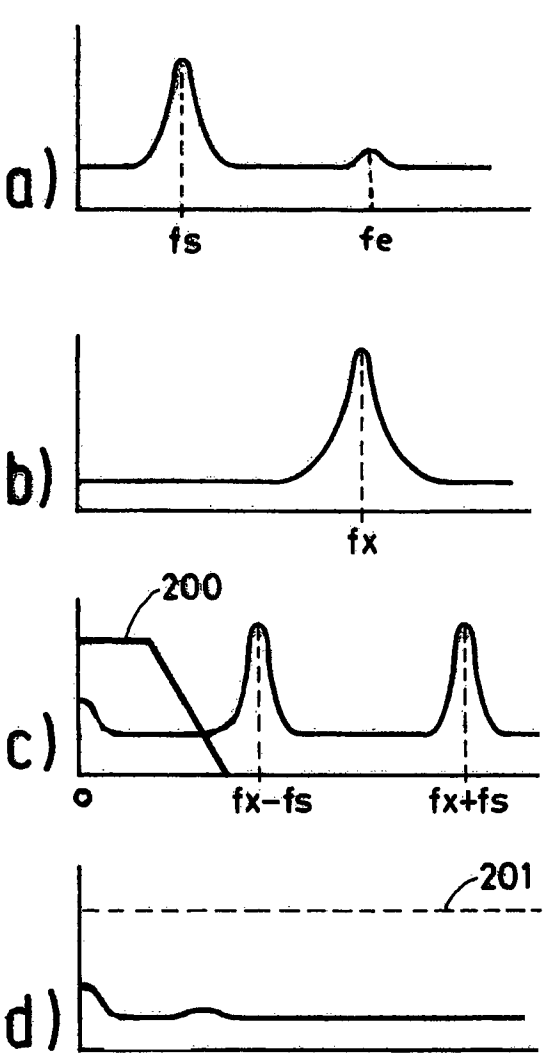

FIGS. 7A and 7B diagrammatically illustrate signals of the kind that can occur in the system according to the present invention. A signal is in each case plotted in arbitrary strength units on the vertical axis against the frequency on the horizontal axis. Under a) a signal is shown in each case of the kind that can occur in line 51 (see FIG. 6). Under b) the fixed signal $f_x$ is given in each case with which the incoming signal $f_s$ is mixed. Under c) the resulting mixed signal is given in each case as it may occur in line 60 (see FIG. 6). Under d) the way in which the filtered signal is compared with a reference signal is shown in each case.

FIG. 7 relates to a duct without any disturbance. Under a) the incoming signal is shown (in this example it is simplified to a signal having a main frequency $f_s$ and a small signal at the natural frequency $f_e$ of the system). This signal is mixed with the natural frequency $f_x$ of the system. The result is the signal shown under c). This signal has two main peaks at the frequencies $f_x-f_s$ and $f_x+f_s$. Around f=0 there is a small mixed peak originating from $f_e$. This signal is filtered using the low-pass filter 200. The filtered signal is shown under d) (continuous line). The reference signal 201 is also shown in the drawing under d). It will be seen that the filtered signal is completely below the reference signal. This corresponds to the status "OK" for the ink duct in question.

FIG. 7B relates to an ink duct that does have a disturbance. In this case the disturbance is an air bubble of a size just equal to the critical size. The incoming signal has an extra peak at a frequency corresponding to the natural frequency of the air bubble, i.e. $f_b$. This frequency $f_b$ corresponds to the natural frequency $f_x$ of the system as shown under b). The signal as shown under c) is obtained by mixing the two signals. This signal has a first peak at the frequency $f_x-f_b\approx 0$, a second peak at the frequency $f_x-f_s$, a third peak at the frequency $f_x+f_s$, and a fourth peak at the frequency $f_x+f_b\approx 2f_x$. The signal as shown under d) with a continuous line forms by the use of a low-pass filter. Comparison with the reference signal 201 shows that the filtered signal is higher at low frequencies than the reference signal. This means that there is a disturbing air bubble present in the duct. This information is passed to the printer control unit, and action can be taken to remove the disturbance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An inkjet system comprising a printhead including an ink-fillable chamber operatively connected to a piezoelectric actuator and provided with a nozzle for the ejection of ink drops in response to the energization of the actuator, said actuator being connected to a measuring circuit for measuring an electrical signal generated by the actuator in response to the deformation thereof, wherein the geometry of the chamber is designed such that a natural frequency of said chamber substantially corresponds to a natural frequency of a disturbance of a pre-chosen size in the chamber.

2. The inkjet system according to claim 1, wherein the natural frequency of the chamber substantially corresponds to a natural frequency of an air bubble of a size such that it noticeably influences the ejection of ink drops.

3. The inkjet system according to claim 1, wherein the measuring circuit comprises a mixer to mix with the signal a frequency which is equal to a natural frequency of the chamber.

4. A method of making an inkjet system which comprises forming an ink chamber with a nozzle for the ejection of ink drops from said chamber, said ink chamber being operatively connected to a piezoelectric actuator, and connecting the actuator to a measuring circuit, wherein a size of a disturbance is determined and the geometry of the chamber is designed such that a natural frequency of said chamber is substantially equal to a natural frequency of a disturbance of a pre-chosen size in the chamber.

5. A method of forming an image on a receiving material using the inkjet system, containing a printhead including an ink-fillable chamber operatively connected to a piezoelectric actuator and provided with a nozzle for the ejection of ink drops in response to the energization of the actuator, said actuator being connected to a measuring circuit for measuring an electrical signal generated by the actuator in response to the deformation thereof, which comprises determining a size of a disturbance and designing the geometry of the chamber such that a natural frequency of the chamber substantially corresponds to a natural frequency of the disturbance whereby the disturbance can be effectively detected in the electrical signal generated by the piezoelectric actuator.

6. The ink jet system of claim 1, wherein the pre-chosen size of the disturbance to be detected is one which just begins to noticeably influence the ejection of the ink drops.

7. The ink jet system of claim 4, wherein the pre-chosen size of the disturbance to be detected is one which just begins to noticeably influence the ejection of the ink drops.

8. The ink jet system of claim 5, wherein the pre-chosen size of the disturbance to be detected is one which just begins to noticeably influence the ejection of the ink drops.

9. The inkjet system according to claim 1, wherein the electrical signal is caused by the energization of the actuator by a signal generator which is used to establish the ejection of the drops.

10. The inkjet system according to claim 1, wherein the system detects the disturbance before it becomes excessive relative to the dimensions of the chamber.

* * * * *